United States Patent [19]

Lehtinen

[11] Patent Number: 4,932,139

[45] Date of Patent: Jun. 12, 1990

[54] METHOD OF AND AN APPARATUS FOR DRYING A FIBRE WEB

[75] Inventor: Jukka Lehtinen, Tampere, Finland

[73] Assignee: Oy Tampella Oy, Tampere, Finland

[21] Appl. No.: 369,054

[22] Filed: Jun. 20, 1989

[30] Foreign Application Priority Data

Jul. 1, 1988 [FI] Finland ..... 883173

[51] Int. Cl.[5] ..... F26B 3/32

[52] U.S. Cl. ..... 34/41; 34/95; 34/152; 34/69

[58] Field of Search ..... 34/12, 13, 14, 71, 73, 34/162, 216, 95, 69, 41, 152, 66

[56] References Cited

U.S. PATENT DOCUMENTS 4,112,586 9/1978 Lehtinen ..... 34/95 X 4,506,456 3/1985 Lehtinen ..... 34/12

4,506,457 3/1985 Lehtinen ..... 34/73 X

*Primary Examiner*—Henry A. Bennet

*Attorney, Agent, or Firm*—Ladas & Parry

[57] ABSTRACT

A method of and an apparatus for a drying fibre web (8) between two metal band (1, 4) moving in the same direction substantially in parallel with each other, whereby the fibre web (8) is led together with a felt (7) between the bands (1, 4), and the band (1) on the side of the web (8) is heated and the band (4) on the side of the felt (7) is cooled. In order to achieve a sufficient drying rate particularly when drying thick web grades while keeping the pressure exerted on the web at a low level, condensing pipes (13*a* to 13*b*) for back-pressure steam are mounted on the surface of the band (1) to be heated on the side facing away from the web (8), and a heat transfer medium, such as heat transfer oil (11) or the like, is provided between the pipes (13*a* to 13*b*) and the band (1).

11 Claims, 2 Drawing Sheets

METHOD OF AND AN APPARATUS FOR DRYING A FIBRE WEB

The invention relates to a method of drying a fibre web, wherein the fibre web is led together with at least one drying felt between two air-tight bands with good thermal conductivity, the bands moving in the same direction at equal rate and being substantially parallel with each other over a distance, whereby the bands enclose the web therebetween over its entire width, thus defining a drying section, the method comprising exposing the web and each drying felt, before being led between the bands, to an air removal treatment for removing substantially all air from their pores; adjusting pressures exerted on the outer surfaces of the bands in such a way that a substantially atmospheric pressure acts on the surface of the upper band while the pressure acting on the surface of the lower band is at least atmospheric though preferably higher to an extent sufficient to compensate for the weight of the bands, the web and the felts; heating the band in contact with the web at least within the drying section for evaporating water from the web; cooling the band making contact with the felt for condensing the steam evaporated from the web into the felt; adjusting the temperature of the band to be cooled by exposing the web to a predetermined compression force preferably less than 100 kPa within the press section; and separating the felt from the web, after the felt and web have exited the section defined by the bands, and removing the condensed water from the felt.

The invention is further concerned with an apparatus for drying a fibre web by a method according to claim 1, comprising two endless, air-tight bands with good thermal conductivity, the bands moving at equal rate substantially in parallel with each other over a distance; air removal means; heating means for heating the band in contact with the web; and cooling means for cooling the band in contact with the felt.

It is known to dry a fibre web between two continuously moving metal bands in such a way that the fibre web is led between the bands together with a drying felt, whereby the metal band in contact with the web is heated while the metal band in contact with the felt is cooled. The water contained in the web is thereby evaporated under the influence of the hot metal band, whereafter it enters the felt due to the pressure of the steam, simultaneously pushing water ahead of it. The steam which has entered the felt is condensed under the influence of the cold band, whereby water enters the felt from the web, and the web dries. In order to achieve this, both the web and the felt or the wire are pretreated with saturated steam before being led into the drying section defined between the bands in such a way that air is removed from their pores as completely as possible.

A method of this kind and an apparatus relating to it are described, e.g., in Finnish Pat. No. 61537, in which the heating of the heated metal band is carried out by feeding hot saturated steam under pressure to its surface facing away from the web. In practice, this is achieved by providing a steam chamber on the outer surface of the metal band, which chamber is sealed at the edges and open towards the moving metal band. Hot saturated steam under pressure is fed into the steam chamber, where it is condensed on to the surface of the metal band, simultaneously giving off heat to the band, and condensed water is removed with separate water removal means. Correspondingly, the cooling of the cooled metal band is effected with cold pressurized water fed into a cooling water chamber sealed against the cooled band at its edges and opening towards it. The steam chamber and the cooling water chamber are positioned accurately opposite to each other, the pressure of the steam and that of the water contained in the cooling water chamber being substantially equal, although the pressure in the lower chamber is higher to an extent sufficient to compensate for the weight caused by the force of gravity due to the mass of the metal band and the cooling medium positioned thereupon.

In the solutions described above, the temperature of the web is very high, typically above 120° C, and the mechanical Z compression caused by the pressurized steam and the pressurized water is high, too, typically more than one bar. When dried in this way a web having a high content of lignin and hemicellulose is provided with excellent strength properties and a smooth surface on the side in contact with the heated metal band. A drawback of the high compression force, however, is that the density of the web in the direction of its thickness becomes very high, that is, the thickness of the web in a way collapses, whereby the rigidity of the web suffers in most cases. In order to avoid this drawback in the solution of the citation, it would be necessary to rise the temperature of the cooling water so close to that of the heating steam that the drying rate would drop remarkably, and the length of the apparatus should be increased unreasonably.

Finnish patent application 880407, in turn, discloses a solution in which no substantial positive pressure is applied to the outside of the metal band within the drying section, but a substantially normal atmospheric pressure acts on the metal bands. The heat energy required to dry the web is obtained by preheating the metal band, so that the stored heat energy causes evaporation of the water contained in the web, thus drying it. When reaching the drying section, the hot metal band is at a temperature of about 150° to 200° C, and it is cooled in the direction of travel of the machine when the heat contained therein is transferred to the web. The web thereby undergoes a mechanical Z compression of no more than about 100 kPa when the temperature of the cooled metal band is kept at a low level, e.g., at about 20° C, by means of a cold water jet, for instance. If the temperature difference between the metal bands remains higher than about 50° C, for instance, the drying rate obtained in this solution will be sufficient in most cases. However, if the solution is to be applied to the drying of heavy web grades, such as folding carton or the like fibre webs having a grammage ranging from 225 to 500 g/m$^2$, the drying rate and drying properties are not adequate. If the drying is started from a water content at which the web leaves the press section, typically about 58% calculated on the total weight of the web, the web should be dried within the first drying section to such an extent that the remaining water content is no more than about 38%; otherwise the web cannot be separated properly from the hot band as it cannot be torn off if the smooth surface finish is to be maintained. Correspondingly, if the grammage of the web is about 250 g/m$^2$, and it is to be dried from a water content of 58% to a water content of 32%, and a steel band with a thickness of 1.2 mm is used as the hot band, the temperature of the band drops about 90° C within the drying section. This is a drawback since the hot band should enter the drying section at a very high temperature, whereby the initial temperature should be about 200° C or more. At the final stage, however, the temperature difference between the hot and the cold band would be relatively small and, accordingly, the drying rate would be low and the length of the drying section should again be increased unreasonably. The heating of the band to a temperature exceeding 200° C is also problematic, because the cost of high-temperature energy is high irrespective of whether the latent enthalpy of back-pressure steam, or fossil primary energy, the most expensive alternative, is used. If the thickness of the steel band is increased in order to solve the problem, further problems are caused in that when the thickness of the band is increased, the diameter of the hitch rolls has to be increased, too, in order that the fatigue occurring in the metal would not damage the band. With a steel band having a thickness of 2 mm, for instance, the hitch rolls should be about 2.5 m in diameter, which causes high costs and requires plenty of room.

The object of the present invention is to provide a drying method and an apparatus by means of which the problems associated with the above-described solutions are avoided when drying thick web grades. This is achieved according to the invention by heating the band to be heated by passing back-pressure steam from a steam turbine through heating pipes for condensing the steam in them and for delivering heat to the walls of the pipes; by transferring the heat contained in the walls of the pipes to the band to be heated by bringing a heat transfer medium into contact with the outer surface of the heating pipes for heating it by the heat contained in the walls of the pipes and by subsequently bringing the heat transfer medium into contact with the outer surface of the band to be heated.

The basic idea of the invention is that the heating of the hot metal band within the drying section is carried out by means of pipes through which back-pressure steam is passed, so that the transfer of heat from the pipes to the band to be heated can be made as efficiently as possible. In one embodiment of the method, it is essential that the pipes comprise at least one substantially planar surface which is substantially parallel with the band to be heated, whereby a nearly non-existent gap is defined between the band and the pipe. The transfer of heat from the surface of the pipe to the band is carried out either by means of a low-viscosity liquid with good chemical resistance properties, such as oil, or air. At least when using air, the pipes have to be so positioned in the chamber sealed against the band that the air moving along with the surface of the band and still containing heat energy is recycled to the entry end of the web for improving the transfer of heat between the band and the pipes. In another embodiment of the invention, it is essential that heat is transferred from the outer surface of the pipes condensing the back-pressure steam by blowing air through a heat transfer cell assembly formed by the pipes. The air is heated by the heat radiating from the surface of the pipes, whereafter the air so warmed up is blown evenly on to the surface of the band. After the air has heated the band, it is recycled by blowing it again through the pipes, which minimizes the waste of energy.

The apparatus according to the invention is characterized in that the heating means comprise heating pipes through which back-pressure steam from a steam turbine is arranged to be passed; and means for passing a heat transfer medium into contact with the pipes and the band to be heated, respectively.

The basic idea of the apparatus is that the heating of the band within the heating section is carried out by transferring the heat energy contained in the back-pressure steam from the surface of the pipes condensing it by means of a medium to the band as efficiently as possible. In one embodiment, it is essential to mount the condensing pipes as close to the surface of the band to be heated as possible and to provide the pipes on the side facing the band with a planar surface extending substantially in parallel with the band in order to obtain a heat transfer surface as large and effective as possible in the direction of the band, whereby the transfer of heat can be made even more efficient by using a thin layer of a suitable medium, such as heat transfer oil, or air. In another embodiment of the apparatus according to the invention, air is heated to a desired temperature by blowing it through a heat transfer cell assembly formed by the pipes condensing back-pressure steam and by passing the air so heated into contact with the band to be heated and by recycling the air which has given off its heat energy to the heating step.

The invention will be described in more detail with reference to the attached drawings, wherein FIG. 1 is a schematical view of one embodiment of the apparatus according to the invention;

Figure 1:
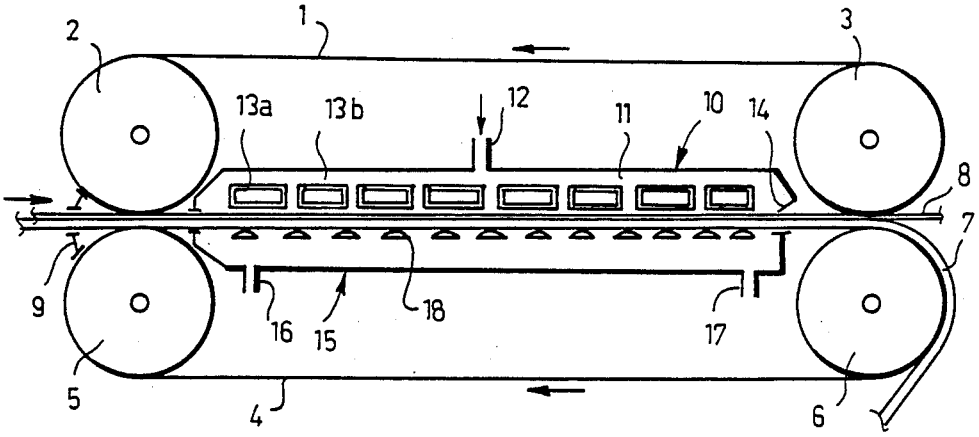

FIG. 1 shows a drying apparatus comprising an endless metal band 1 which goes around hitch rolls 2 and 3. The apparatus further comprises another endless metal band 4 which goes similarly around hitch rolls 5 and 6 and is parallel with and moves in the same direction as the band 1 side by side therewith between the rolls. A drying felt 7 and a web 8 move between the bands in such a manner that the felt makes contact with the band 4 and the web 8 with the band 1. The apparatus also comprises air removal means at the entry end of the felt 7 and web 8. In the air removal means, hot saturated steam is blown through the web and the felt in order to remove the air contained in their pores and to replace it with steam. A heating chamber 10 containing heat transfer medium such as oil 11 is provided on the surface of the band 1 on the side facing away from the web, that is, on its outer surface. Possible loss of the medium can be compensated for by feeding more medium through a pipe 12, if required.

Within the chamber 10, there are further provided heat transfer pipes 13*a* to 13*b* in which back-pressure steam flows so as to be condensed on to the surface of the pipes, thus transferring heat energy contained therein into the pipes. The pipes 13*a* to 13*b* comprise a planar surface extending substantially in parallel with the surface of the band 1, the planar surface being positioned at a very small distance from the outer surface of the band 1. When the pipes get warm, the heat transfer medium in the gap between them and the band 1 passes heat from the pipes to the surface of the band 1, thus heating it. As the pipes 13*a* to 13*b* are positioned substantially over the whole area of the drying section, the band 1 is heated so that the web 8 will dry sufficiently while it is being passed through the drying section. A doctor blade 14 is mounted to be positioned against the surface of the band 1 at the terminal end of the chamber 10. The doctor blade wipes off oil from the surface of the band 1 as accurately as possible, recovering the oil and preventing it from spreading within the rest of the machinery.

A cooling medium chamber 15 is mounted opposite to the chamber 10 to exert a pressure on the outer surface of the band 4, that is, on the side facing away from the felt. Cooling medium is introduced into the chamber 15 and removed therefrom through conduits 16 and 17. Within the chamber, there are further provided slide shoes or cleats 18 which support the band 4 from below, preventing it from sagging. The pressure of the cooling medium contained in the chamber 15 exceeds the atmospheric pressure to an extent sufficient to compensate for forces caused by the weight of the bands, the felt, the web and the cooling medium in the heating chamber 10, thus keeping the band 4 substantially straight.

Figure 2:
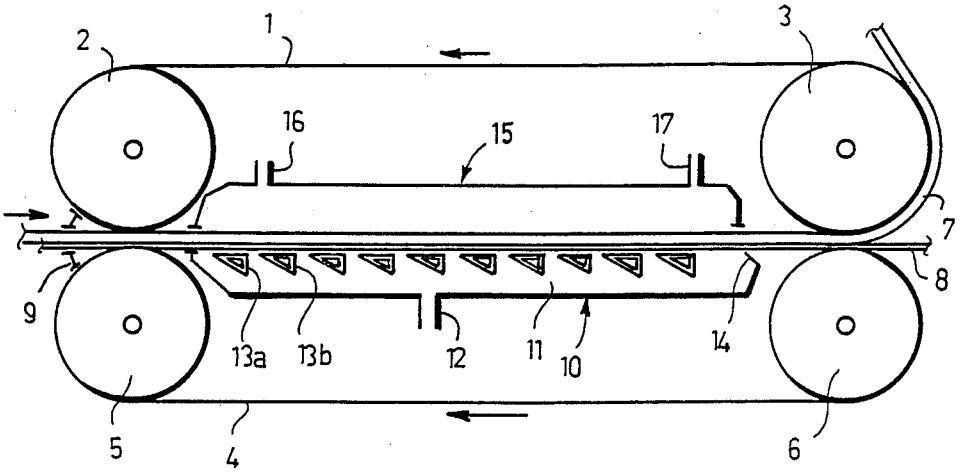
FIG. 2 is a schematical view of another embodiment of the apparatus according to the invention.

FIG. 2 shows an apparatus corresponding to the solution of FIG. 1 except that the heating chamber and the heated band are positioned at the bottom while the cooled band and the cooling chamber are positioned at the top. In this embodiment, the heating pipes 13*a* to 13*b* are triangular in cross-section. When the band 1 transports oil with it, an oil layer as thin as possible is formed between the heating pipe and the band in order that the heat transfer rate could be kept sufficiently high. The same reference numerals as in FIG. 1 are used for corresponding parts in FIG. 2.

Figure 3:
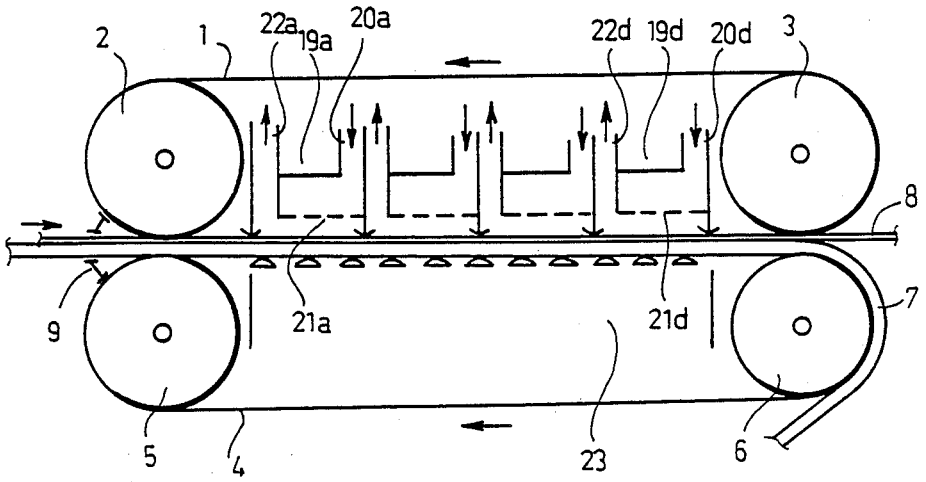
FIG. 3 is schematical view of still another embodiment of the apparatus according to the invention.

FIG. 3 shows an apparatus in which the metal band 1 is heated by hot air. Hot air is blown from conduits 20*a* and 20*d*, whereby it spreads substantially evenly by virtue of grates 21*a* to 21*d* on the heated band, heating it to a desired temperature. Cooled air is removed through conduits 22*a* to 22*d* and recycled to the heating step in order to recover the remaining heat energy. The band 4 can be cooled within the length of a cooling section 23 suitably in any known way, provided that the pressure exerted on the band 4 is only slightly higher than atmospheric pressure.

Figure 4:
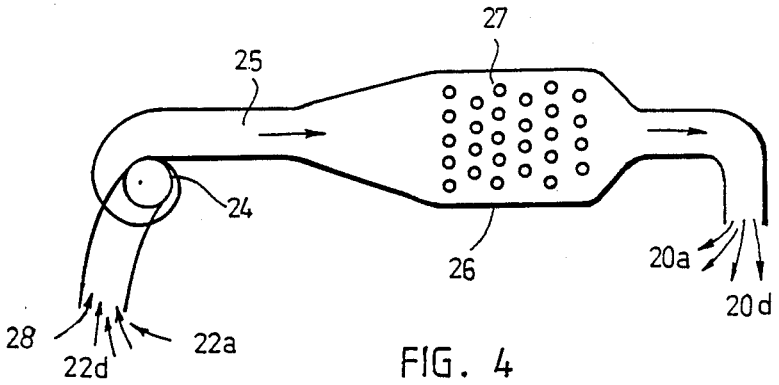
FIG. 4 shows a construction for heating air in the apparatus of FIG. 3.

FIG. 4 shows air heating means by means of which the band can be heated as shown in FIG. 3. The means comprise a centrifugal blower 24 which sucks air from the conduits 22*a* to 22*d* and blows it onwards through a conduit 25 into the heating chamber 26. Pipes 27 condensing back-pressure steam are arranged to extend across the heating chamber so as to form a heat transfer cell assembly. After the convector, the pressure causes the hot air to be passed into the conduits 20*a* to 20*d*, thus heating the band 1. Thereafter it returns to the blower 24 at a diminished temperature. Additional air is introduced into the blower through a conduit 28 in an amount sufficient to compensate for the air losses.

Figure 5:
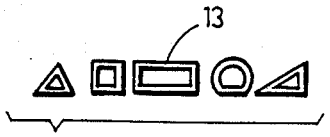
FIG. 5 shows a few pipe shapes suited for the pipes condensing back-pressure steam in the apparatus of FIGS. 1 and 2.

FIG. 5 shows schematically suitable cross-sectional shapes for the back-pressure steam condensing pipes used in realizing the embodiments of the invention. The pipes of all these cross-sections comprise at least one planar surface which can be arranged to extend in parallel with the band to be heated at a small distance therefrom.

Only a few embodiments of the method and the apparatus according to the invention have been described above, and the invention is in no way restricted thereto. When oil o some other liquid is used as heat transfer medium, this liquid can usually also serve as a lubricant. However, if air or gas is used, it may be necessary to coat the condensing pipes 13*a* to 13*b* and/or the metal band 1 with a fixed lubricant such as teflon or a low-friction ceramic layer or the like on the sides to be positioned against each other in order to avoid damages when the metal surfaces come into contact with each other.

I claim:

1. A method of drying a fibre web (8), wherein the fibre web (8) is led together with at least one drying felt (7) between two air-tight bands (1, 4) with good thermal conductivity, the bands moving in the same direction at equal rate and being substantially parallel with each other over a distance, whereby the bands (1, 4) enclose the web (8) therebetween over its entire width, thus defining a drying section, the method comprising exposing the web (8) and each drying felt (7), before being led between the bands (1, 4), to an air removal treatment for removing substantially all air from their pores;

adjusting pressures exerted on the outer surfaces of the bands (1, 4) in such a way that a substantially atmospheric pressure acts on the surface of the upper band (1) while the pressure acting on the surface of the lower band (4) is at least atmospheric though preferably higher to an extent sufficient to compensate for the weight of the bands (1, 4), the web (8) and the felts (7);

heating the band (1, 4) in contact with the web (8) at least within the drying section for evaporating water from the web (8);

cooling the band (1, 4) making contact with the felt (7) for condensing the steam evaporated from the web (8) into the felt (7);

adjusting the temperature of the band (1, 4) to be cooled by exposing the web (8) to a predetermined compression force preferably less than 100 kPa within the press section; and separating the felt (7) after the bands (1, 4) from the web (8) and removing the condensed water from it, characterized by heating the band (1, 4) to be heated by passing back-pressure steam from a steam turbine through heating pipes (13*a* to 13*b*, 27) for condensing the steam in them ad for delivering heat to the walls of the pipes (13*a* to 13*b*, 27);

by transferring the heat contained in the walls of the pipes (13*a* to 13*b*, 27) to the band (1, 4) to be heated by bringing a heat transfer medium (11) into contact with the outer surface of the heating pipes (13*a* to 13*b*, 27) for heating it by the heat contained in the walls of the pipes (13*a* to 13*b*, 27) and by subsequently bringing the heat transfer medium (11) into contact with the outer surface of the band (1, 4) to be heated.

2. A method according to claim 1, characterized in that after having delivered part of its heat energy to the band (1, 4) to be heated, the heat transfer medium (11) is recycled so as to be again brought into contact with the heating pipes (13*a* to 13*b*, 27) and the band (1, 4) to be heated.

3. A method according to claim 1, characterized in that the heat transfer medium (11) is heat transfer oil; and that the oil is arranged to form a thin film between the band (1, 4) to be heated and the heating pipes (13*a* to 13*b*), at least one side of the heating pipes (13*a* to 13*b*) being substantially planar, whereby the heating pipes (13*a* to 13*b*) are positioned in the drying section with the planar surface extending in parallel with the band (1, 4) to be heated, at a small distance therefrom.

4. A method according to claim 3, characterized in that the band (4) to be heated is the lower band (4) and that the heat transfer oil is arranged to act as a lubricant supporting the band (4) between the band (4) and the heating pipes (13*a* to 13*b*).

5. A method according to claim 1, characterized in that the heat transfer medium (11) is air which is blown between the heating pipes (27) and then passed into contact with the outer surface of the band (1, 4) to be heated.

6. A method according to claim 5, characterized in that the air is blown through nozzles substantially perpendicularly to the surface of the band (1, 4) to be heated.

7. An apparatus for drying a fibre web (8) by a method according to claim 1, comprising two endless, air-tight bands (1, 4) with good thermal conductivity, the bands moving at equal rate substantially in parallel with each other over a distance; air removal means (9); heating means (11, 12, 13*a* to 13*b*; 19 to 27) for heating the band (1, 4) in contact with the web (8); and cooling means (15 to 17) for cooling the band (1, 4) in contact with the felt (7), characterized in that the heating means (11, 12, 13*a* to 13*b*; 19 to 27) comprise heating pipes (13*a* to 13*b*; 27) through which back-pressure steam from a steam turbine is arranged to be passed; and means (19 to 26) for passing a heat transfer medium (11) in contact with the pipes (13*a* to 13*b*) and the band (1, 4) to be heated, respectively.

8. An apparatus according to claim 7, characterized in that at least one side of the heating pipes (13*a* to 13*b*) is planar; that the heating pipes (13*a* to 13*b*) are mounted in the drying section with the planar surfaces extending substantially in parallel with the band (1, 4) to be heated at a distance therefrom; and that the heat transfer medium (11) is heat transfer oil forming a thin film between the heating pipes (13*a* to 13*b*) and the band (1, 4) to be heated.

9. An apparatus according to claim 8, characterized in that the heating pipes (13*a* to 13*b*) are triangular in shape and that an acute angle of the triangle is arranged to project towards the direction of entry of the band (1, 4).

10. An apparatus according to claim 7, characterized in that the heat transfer medium (11) is air, that the heating pipes (27) are arranged to form a heat transfer cell assembly through which air is blown; and that the heated air is passed through nozzle means (19*a* to 19*d*) so as to flow along the surface of the band (1, 4) to be heated.

11. An apparatus according to claim 10, characterized in that the nozzle means are formed by at least one perforated plate (21*a* to 21*d*), the air being blown through the holes of the plate towards the surface of the band (1, 4); and that a discharge conduit (22*a* to 22*d*) is provided at the edge of each perforated plate (21*a* to 21*d*) for removing the air flown along the surface of the band (1, 4).

* * * * *